US005339059A

United States Patent [19]

Kawamura et al.

[11] Patent Number: 5,339,059

[45] Date of Patent: Aug. 16, 1994

[54] ELECTROMAGNETIC RELAY

[75] Inventors: Shotaro Kawamura, Kariya; Hiroshi Yamada, Aichi, both of Japan

[73] Assignees: Anden Co., Ltd., Anjo; Nippondenso Co., Ltd., Kariya, both of Japan

[21] Appl. No.: 102,254

[22] Filed: Aug. 5, 1993

[30] Foreign Application Priority Data

Aug. 7, 1992 [JP] Japan ..... 4-232994

[51] Int. Cl.[5] ..... H01H 51/22

[52] U.S. Cl. ..... 335/78; 335/86

[58] Field of Search ..... 335/78–86, 335/196, 273–276, 270; 200/251, 67 D, 67 DA, 261

[56] References Cited

U.S. PATENT DOCUMENTS 4,224,488 9/1980 Rossi ..... 200/251
4,803,451 2/1989 Lueneburger .
4,926,150 5/1990 Backschmid et al. .

FOREIGN PATENT DOCUMENTS 0252343 1/1988 European Pat. Off. .
2500786 3/1990 Japan .
8804466 6/1988 PCT Int'l Appl. .
611814 11/1948 United Kingdom .
770308 3/1957 United Kingdom .
2072949 10/1981 United Kingdom .

*Primary Examiner*—Lincoln Donovan
*Attorney, Agent, or Firm*—Cushman, Darby & Cushman

[57] ABSTRACT

An electromagnetic switch is provided which comprises a movable switching contact movably supported by a movable switching contact assembly arranged on a support plate, a fixed switching contact, a magnetic coil assembly operable to urge the movable switching contact into contact with the fixed switching contact, and a retainer for retaining the fixed switching contact apart from the movable switching contact at a preselected interval. The retainer includes a switching contact mounting portion, a supporting portion secured to the support plate, and first and second connecting portions connecting the switching contact mounting portion and the supporting portion to form a polygonal frame structure which is so constructed as to be deformed under preselected forces applied thereto to adjust the positional relation between the movable and fixed switching contacts.

11 Claims, 2 Drawing Sheets

ELECTROMAGNETIC RELAY

BACKGROUND OF THE INVENTION

1. Field of The Invention

The present invention relates generally to an electromagnetic relay. More particularly, the invention is directed to a switching contact supporting arrangement of an electromagnetic relay which facilitates easy adjustment of a gap between fixed and movable switching contacts.

2. Description of The Prior Art

Recently, with electrical and electric equipments getting smaller, there is an increasing need for a small electromagnetic relay. In order to miniaturize the electromagnetic relay without degrading its functional performance, high assembling accuracy as well as machining accuracy of component parts which make up the electromagnetic relay is necessary for setting an interval between fixed and movable switching contacts to a desired value. It is, however, difficult to further improve the machining accuracy of the component parts under economical restrictions.

Accordingly, in a conventional electromagnetic relay, in order to adjust the interval between the fixed and movable switching contacts, a position of a yoke, a core, or a coal assembly needs to be adjusted finely during assembling operations. This requires extra assembling equipments, resulting in manufacturing costs being increased.

SUMMARY OF THE INVENTION

It is therefore a principal object of the present invention to avoid the disadvantages of the prior art.

It is another object of the present invention to provide an electromagnetic relay which is simple in design and which is capable of adjusting the positional relation between fixed and movable contacts easily.

According to one aspect of the present invention, there is provided an electromagnetic switch which comprises a support plate, a movable switching contact movably supported by a movable switching contact assembly arranged on the support plate, a fixed switching contact, a magnetic coil assembly responsive to a control switching signal to urge the movable switching contact assembly so that tile movable switching contact engages the fixed switching contact, and a retainer means for retaining the fixed switching contact apart from the movable switching contact at a preselected interval, the retainer means including a switching contact mounting portion disposing thereon the fixed switching contact, and a supporting portion secured to the support plate, and first and second connecting portions connecting between the switching contact mounting portion and the supporting portion, the first and second connecting portions being attached to the switching contact mounting portion at first and second attachment points respectively to be deformed under preselected forces applied thereto to move the switching contact mounting portion for adjusting a positional relation between the movable and fixed switching contacts.

In the preferred mode, the first and second connecting portions connect between the switching contact mounting portion and the supporting portion respectively to form a polygonal frame structure. The polygonal frame structure may include therein an aperture defined by a hexagonal frame. Additionally, the polygonal frame structure may include a plurality of notches formed in inside corners thereof for avoiding stress concentration when subjected to the preselected forces during deforming operations.

The retainer means may be provided with a single plate member which is folded to form a polygonal frame structure including the switching contact mounting portion, the first and second connecting portions, and the supporting portion.

BRIEF DESCRIPTION OF THE DRAWINGS

The present invention will be understood from the detailed description given hereinbelow and from the accompanying drawings of the preferred embodiments which are given for explanation and understanding only and are not intended to imply limitations to the invention.

In the drawings.

DESCRIPTION OF THE PREFERRED EMBODIMENT

Figure 1:
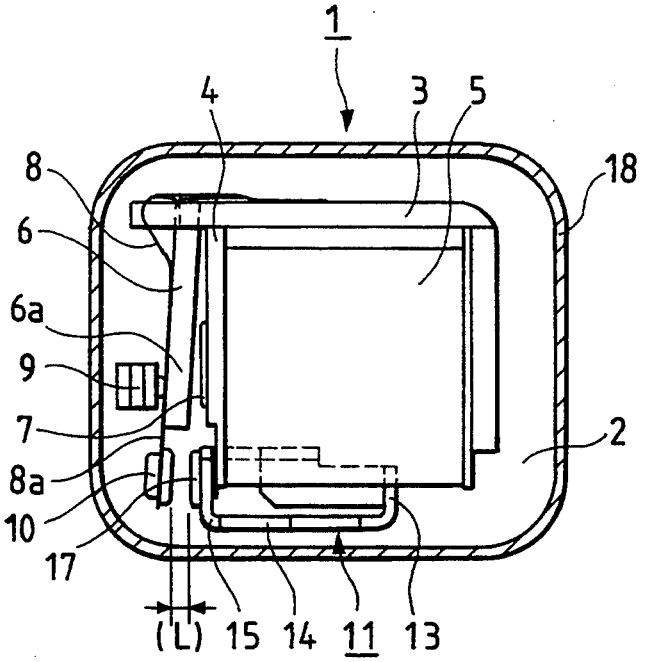
FIG. 1 is a partially cutaway plan view which shows an electromagnetic relay according to the present invention.
Figure 2:
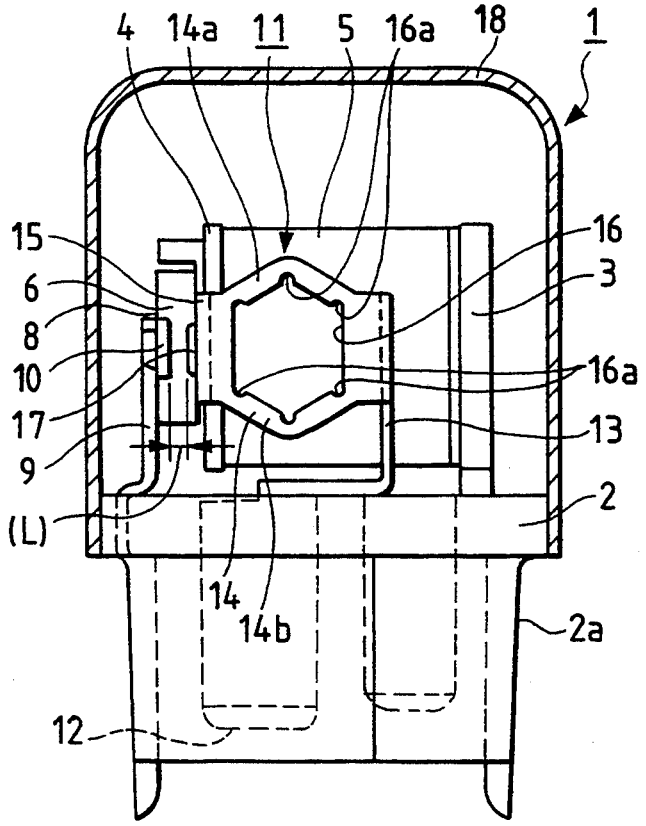
FIG. 2 is a front view which shows an electromagnetic relay shown in FIG. 1.

Referring now to the drawings, particularly to FIGS. 1 and 2, there is shown an electromagnetic relay 1 according to the present invention. The electromagnetic relay 1 includes generally a support plate 2, a cover 18 engaging the support plate, an L-shaped stationary yoke 3 fixed on the support plate, a coil bobbin 4 about which an electromagnetic coil 5 is wound, a movable yoke 6, and a core 7 disposed in the coil bobbin 4. The movable yoke is pivotally supported at its end by the yoke 3 with the other end **6*a* thereof being opposed to the core 7. The stationary yoke 3, the movable yoke 6, and the core 7** complete an electromagnetic circuit.

A leaf spring 8 is attached to the stationary yoke 3 and the movable yoke 6 in the illustrated manner so that it produces a spring force to urge the movable yoke 6 into constant engagement with a stopper 9 installed on the support plate 2. A movable switching contact 10 is welded on an extending portion **8*a* of the leaf spring 8. The switching contact 10 may alternatively be caulked on the extending portion 8*a***.

Figure 5:
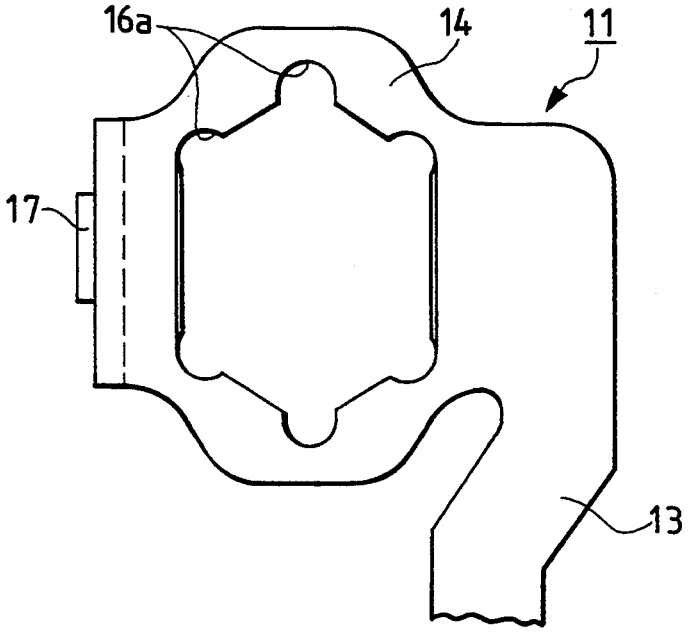
FIG. 5 is a plan view which shows another modification of a switching contact retainer according to the present invention.

A fixed switching contact retainer 11 includes a single conductive metal plate which is pressed to form a terminal portion 12, an L-shaped leg portion 13 secured to the support plate 2, a plastically deforming portion 14, and a switching contact mounting portion 15. A fixed switching contact 17 is welded or caulked on a substantially central portion of a surface of the switching contact mounting portion 15 in a width direction thereof. The leg portion 13 is secured to the support plate 2 and supports the switching contact mounting portion 15 in its place. The terminal portion 12 is inserted through the support plate 2 into a skirt portion **2*a* which is integrally formed on the bottom of the support plate 2 and extends outwardly for attachment to a circuit chassis, for example. The switching contact mounting portion 15 extends perpendicular to the plastically deforming portion 14. The plastically deforming portion 14 extends perpendicular to the leg portion 13 and includes a polygonal, for example, hexagonal frame which is formed with curved connecting portions 14***a* and 14*b* connecting between the switching contact mounting portion 15 and the leg portion 13 respectively to define a hexagonal aperture 16. The leg portion 13, as shown in FIG. 5, may alternatively extend horizontally from the plastically deforming portion 14.

Additionally, semicircular cutout portions, or notches 16*a* are formed in inside corners of the hexagonal frame of the plastically deforming portion 14 for avoiding stress from concentrating at the corners, which may cause cracks and damage, when the hexagonal frame is plastically deformed.

With the above arrangements, the fixed switching contact retainer 11 is, as shown in FIG. 1, so arranged that the plastically deforming portion 14 extends in parallel to the periphery of the magnetic coil 5 and the fixed switching contact 17 is located opposite the movable switching contact 10 at a preselected interval L therebetween. In operation, when a switching control signal, or switching current is applied to the electromagnetic coil 5, the coil is energized so that the core 7 pulls the movable yoke 6 thereto to establish engagement between the movable and fixed switching contacts 10 and 17.

As the manner in which the above listed elements cooperate with one another is very well known and not directly related to the point of the invention, further discussion of the same will be omitted for the sake of brevity. Hereinafter, fine adjustment of the interval L between the movable switching contact 10 and the fixed switching contact 17 to which tile present invention is directed will be described in detail.

Figure 3:
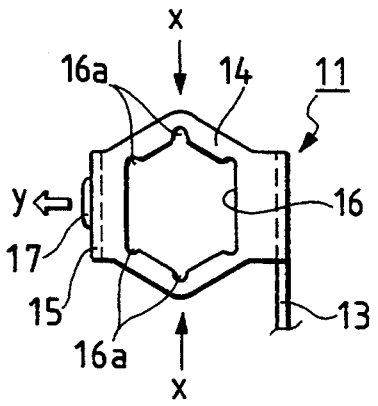
FIG. 3 is an explanatory view for demonstrating plastic deformation of a switching contact retainer.

As shown in FIG. 3, pressing the plastically deforming portion 14 of the fixed switching contact retainer 11 under preselected forces uniformly applied from opposite directions X causes it to be plastically deformed to extend in a direction Y so that the switching contact mounting portion 15 is moved to shorten the interval L between the fixed switching contact 17 and the movable switching contact 10 to assume a desired position. Alternatively, when the plastically deforming portion 14 is pressed under forces applied from directions perpendicular to the directions X, it will cause the contact mounting portion 15 to be moved to lengthen the interval L. It is preferable that the plastic deformation be made under forces acting outwardly from the inside of the plastically deforming portion 14. Additionally, by applying the force to either one of the connecting portions 14*a* and 14*b*, an angular position, or inclination of the fixed switching contact 17 relative to the movable switching contact 10 may also be adjusted since the connecting portions 14*a* and 14*b* are attached to edge portions of the switching contact mounting portion 15 in a width-wise direction at two attachment points.

The springback indicative of the degree to which the plastically deforming portion 14 returns its original shape after forming operations may generally be considered to be within allowable tolerance of the interval L between the contacts 10 and 17. It is preferable however, that additional forces be further applied to the plastically deforming portion 14 for compensating the springback to adjust the interval L more finely.

Figure 4:
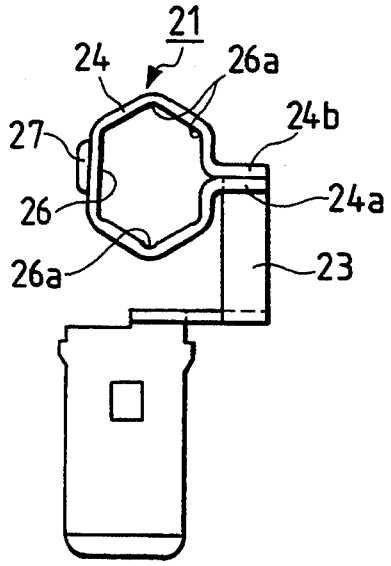
FIG. 4 is a front view which shows a modification of a switching contact retainer according to the present invention.

Referring to FIG. 4, there is shown an alternative embodiment representing a modification of the fixed switching contact retainer 11 as described above.

A fixed switching contact retainer 21 includes a plastically deforming portion 24 formed with a conductive single metal strip plate which is folded so that a bottom end portion 24*a* continuing from a leg portion 23 and a top end portion 24*b* are joined to each other to define a hexagonal frame having therein an aperture 26. A fixed switching contact 27 is secured on an outer surface of the hexagonal frame. Inside corners of the hexagonal frame are stamped to form indentations or notches 26*a* for preventing stress from concentrating threat during plastically deforming operations. According to the construction of this second embodiment, the plastically deforming portion 24 may be deformed to assume different geometries dependent upon directions of forces applied thereto to desirably position the fixed switching contact 27 relative to the movable switching contact 10.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An electromagnetic switch comprising:

a support plate;

a movable switching contact movably supported by a movable switching contact assembly arranged on said support plate;

a fixed switching contact;

a magnetic coil assembly responsive to a control switching signal to urge said movable switching contact assembly so that said movable switching contact engages said fixed switching contact; and retainer means for retaining said fixed switching contact apart from said movable switching contact at a preselected interval, said retainer means including:

a switching contact mounting portion having disposed thereon said fixed switching contact, said switching contact mounting portion including a first attachment point and a second attachment point;

a supporting portion secured to said support plate; and first and second connecting portions extending between said switching contact mounting portion and said supporting portion, said first and second connecting portions being attached to said switching contact mounting portion at said first and second attachment points, respectively, said first and second connecting portions including first and second curved portions, respectively, said first and second curved portions being geometrically oriented so as to be deformable when preselected forces are applied to said first and second curved portions in opposite directions to each other, thereby changing an interval between said switching contact mounting portion and said supporting portion and moving said switching contact mounting portion so as to adjust a positional relation between said movable and fixed switching contacts when said moveable and fixed switching contacts are not engaged.

2. An electromagnetic switch as set forth in claim 1, wherein the first and second connecting portions connect between the switching contact mounting portion and the supporting portion respectively to form a polygonal frame structure.

3. An electromagnetic switch as set forth in claim 2, wherein the polygonal frame structure includes therein an aperture defined by a hexagonal frame.

4. An electromagnetic switch as set forth claim 2, wherein the polygonal frame structure includes a plurality of notches formed in inside corners thereof for avoiding stress concentration when subjected to the preselected forces during deforming operations.

5. An electromagnetic switch as set forth in claim 1, wherein said retainer means is provided with a single plate member which is folded to form a polygonal frame structure including time switching contact mounting portion, the first and second connecting portions, and the supporting portion.

6. An electromagnetic switch as set forth in claim 1, wherein said first and second curved portions have corners, and wherein each corner has a notch for allowing said first and second curved portions to be deformable when said preselected forces are applied thereto.

7. An electromagnetic switch as set forth in claim 6, wherein said switching contact mounting portion has edge portions, said edge portions having said first and second attachment points attached thereto, said fixed switching contact being arranged on said switching contact mounting portion between said first and second attachment points.

8. A method for adjusting a positional relation between a movable switching contact and a fixed switching contact in an electromagnetic switch, said electromagnetic switch having:

a support plate;

a movable switching contact assembly disposed on said support plate;

the movable switching contact which is movably supported by said movable switching contact assembly;

the fixed switching contact;

a magnetic coil assembly which is responsive to a control switching signal so as to urge said movable switching contact assembly, thereby causing said movable switching contact to engage said fixed switching contact; and retainer means for retaining said fixed switching contact, said retainer means including:

a switching contact mounting portion having disposed thereon said fixed switching contact, said switching contact mounting portion having first and second attachment points;

a supporting portion secured to said support plate; and first and second connecting portions extending between said switching contact mounting portion and said supporting portion, said first and second connecting portions being attached to said switching contact mounting portion at said first and second attachment points, said first and second connecting portions having first and second curved portions, respectively;

the method comprising said steps of:

(a) disposing said retainer means so as to retain said fixed switching contact at a preselected interval away from said movable switching contact; and (b) placing preselected forces in opposite directions to each other on said first and second curved portions of said first and second connecting portions so as to geometrically reorient said first and second curved portions, thereby changing an interval between said switching contact mounting portion and said supporting portion and moving said switching contact mounting portion so as to adjust a positional relation between said movable and fixed switching contacts.

9. The method according to claim 8, wherein said first and second connecting portions, which connect said switching contact mounting portion and said supporting portion, create a polygonal frame, and said placing step includes the step of placing said preselected forces on opposite sides of said polygonal frame so as to deform said polygonal frame.

10. The method according to claim 8, wherein said first and second curved portions have corners, each corner having a notch so as to allow said first and second curved portions to be deformed when said preselected forces are applied thereto, and said placing step includes the step of placing said preselected forces on two of said notches which are disposed opposite to one another so as to deform said two of said notches.

11. The method according to claim 8, wherein said switching contact mounting portion has edge portions, said edge portions having said first and second attachment points attached thereto, said fixed switching contact being arranged on said switching contact mounting portion between said first and second attachment points, and said placing step includes the step of placing said preselected forces in opposite directions to each other on said first and second curved portions of said first and second connecting portions so as not to be applied to said first and second connecting portions, thereby deforming said first and second curved portions.

* * * * *